US005534341A

United States Patent [19]

Baines et al.

[11] Patent Number: 5,534,341

[45] Date of Patent: Jul. 9, 1996

[54] EMULSION BINDERS

[75] Inventors: Stephen J. Baines, Horsham; Barry Hayward, Wallington, both of United Kingdom

[73] Assignee: Unilever Patent Holdings BV, Rotterdam, Netherlands

[21] Appl. No.: 436,821

[22] Filed: May 8, 1995

Related U.S. Application Data

[63] Continuation of Ser. No. 831,097, Feb. 10, 1992, abandoned, which is a continuation of Ser. No. 406,328, Sep. 12, 1989, abandoned.

[30] Foreign Application Priority Data

Sep. 12, 1988 [GB] England ..... 8821350

[51] Int. Cl.[6] ..... D04H 1/58; B32B 27/00

[52] U.S. Cl. ..... 428/288; 428/290

[58] Field of Search ..... 428/288, 290

[56] References Cited

U.S. PATENT DOCUMENTS

| | | | |
|---|---|---|---|
| 3,753,842 | 8/1973 | Pittman | 428/224 |
| 4,199,490 | 4/1980 | Kamiya et al. | 524/505 |
| 4,320,166 | 3/1982 | Endo et al. | 428/288 X |
| 4,405,325 | 9/1983 | Antlfinger et al. | 428/288 X |
| 4,481,248 | 11/1984 | Fraige | 428/283 |
| 4,507,342 | 3/1985 | Kielbania, Jr. | 428/290 X |
| 4,670,505 | 6/1987 | Craig . | |
| 4,683,165 | 7/1987 | Lindemann et al. | 428/290 |
| 4,957,806 | 9/1990 | Pangrazi et al. | 428/290 X |

FOREIGN PATENT DOCUMENTS

| | | |
|---|---|---|
| 0012033 | 6/1980 | European Pat. Off. . |
| 0071929 | 2/1983 | European Pat. Off. . |
| 365133 | 4/1990 | European Pat. Off. . |
| 2747182 | 4/1979 | Germany . |

*Primary Examiner*—Terrel Morris
*Attorney, Agent, or Firm*—Cushman Darby & Cushman

[57] ABSTRACT

Lofted non-woven materials are formed by bonding fibres and used for, e.g. furniture filing and heat insulation. The flammability of these materials is an important characteristic. The use of copolymer emulsions having defined Tg, molecular weight and solution viscosity as binders allows the material to melt away from an open flame. Thus the flammability of the non-woven material is reduced.

7 Claims, No Drawings

EMULSION BINDERS

This is a continuation of application Ser. No. 7/831,097, filed on Feb. 10, 1992, which was abandoned upon the filling hereof; which was a continuation of application Ser. No. 07/406,328 filed Sep. 12, 1989, now abandoned.

FIELD OF THE INVENTION

This invention relates to lofted non-woven materials formed by bonding fibres, for example of polyester, for use in applications where upholstery filling or heat insulation is required. Examples of such applications are in furniture, clothing and bedding. These materials are also known as batting and high loft wadding in commercial fields.

BACKGROUND TO THE INVENTION

The preparation of a lofted non-woven material is a well characterised procedure in industry and it is a basic product for use in manufacture of furniture where it is usually placed immediately beneath the decorative fabric covering. One area in which furniture has been required to be improved in recent years is in the flammability of the constituent materials. Thus the flammability of the lofted non-woven material is of considerable importance in meeting the standards imposed by Governmental Agencies for reasons of safety.

GENERAL DESCRIPTION OF THE INVENTION

The invention provides a lofted non-woven material in which the bonding is achieved with the use of an emulsion binder having specified characteristics. The binder is required to have a $T_g$ of from 20° C. preferably above 30° C. to 60° C., be substantially non-crosslinked or non-crosslinkable on drying, have a weight average molecular weight less than about $3\times10^6$, preferably below about $1\times10^6$. Tg was calculated using the literature values for homopolymers and applying the Fox equation for copolymers. The latter characteristic is a suitable determinant because the emulsions used in the invention are required to have a reduced content of higher molecular weight polymers. A level of Tg at or above 20° C. is necessary to ensure the resultant non woven material has a reasonable stiffness for use. The molecular weight was measured using gel permeation chromatography with the method described in a later passage. The limit on crosslinked content allowed in the copolymer is defined by requiring at least about 80% of the copolymer being soluble in THF at 25° C. The polymers, to be effective, will have a low inherent flammability themselves.

Preferably the polymer has a solution viscosity below about 0.15 poise, preferably below about 0.10 poise, in tetrahydrofuran (10% solids); although styrene acrylate emulsions could be effective at solution viscosities up to 0.5 poise.

Preferably the copolymer emulsion have been formed by stabilisation with surfactants and protective colloids with the substantial avoidance of the use of polyvinyl alcohol i.e. if polyvinyl alcohol is present in the stabilising system it should form not more than about 3% by weight on the total monomer feedstock.

The molecular weights of the emulsions can be controlled by mechanisms well characterised in the literature eg. chain transfer agents, process temperature control and initiator concentration.

The invention extends to novel copolymer emulsions characterised by i) a Tg from about 20° C. preferably from about 30° C., to about 60° C. ii) a weight average molecular weight less than about $5\times10^5$ preferably below about $10^5$, substantially free of crosslinking or being crosslinkable on drying, and iii) a ratio of Mw/Mn below about 5.

The ratio of weight average molecular weight (Mw)/number average molecular weight (Mn) gives a measure of the spread of molecular weights.

Preferably the copolymer emulsion binder is based on a monomer feedstock comprising at least about 40% by weight of a vinyl C1 to C3 alkanoate. Preferably, the vinyl alkanoate is vinyl acetate but vinyl butyrate and propionate are also usable. Vinyl alkanoates are a preferred monomer because of the commercial availability and economics. Copolymers based on acrylate as the major monomer and styrene-butadiene and styrene-acrylate copolymers are also usable in the binders of the invention.

Typically a Tg in the range 20° C. to 60° C. is provided by the following classes of copolymers.

i) Styrene 73 to 88%/butadiene 12 to 27% ii) Styrene 55 to 80%/acrylate(eg butyl) 20 to 45% iii) Vinyl acetate 40 to 100%/vinyl chloride 0 to 60% vinyl acetate is an example of a vinyl C1 to C3 alkanoate.

iv) Acrylic (eg methyl methacrylate-butyl acrylate 55 to 80%–20 to 45%)

v) Vinyl acetate 0 to 100%/dimethylmaleate 0 to 100%.

Optional comonomers usable with the vinyl alkanoate are vinyl chloride, ethylenic hydrocarbons, eg ethylene, propylene and butylene, alkyl maleates, eg dialkyl (C1–C4) maleates and longer chain length vinyl alkanoates.

Methods for preparing the copolymer emulsions of the invention are well characterised in the literature. Polymer Synthesis (vols I and III) by Sandler & Karo (Academic Press 1974) and Preparative Methods of Polymer Chemistry (2nd Ed) by Sorenson and Campbell (Interscience 1968) provide preparative information. Methoden der Organischen Chemie (Houben-Wey) Band XIV published by George Thieme Verlag Stuttgart (1961) also provides preparative descriptions.

The binder emulsions of the invention provide lofted non-wovens with suitable properties of hardness and stiffness for use, and resilience for handling and vacuum packing even when warm after manufacture. The copolymers present melt on application of a flame and shrink back from the flame without forming a gel which holds the fibres in place. The fibres would burn and propagate the flame if held in place.

Although the weight average molecular weight (Mw) and THF (10%) viscosity have been identified as features of the polymer emulsion used to provide fire retardancy it must be understood the structure of the non woven materials is at the choice of the manufacturer. Thus commercial lofted non woven materials may contain coated fibres, different levels of binder and multi-layer construction.

LITERATURE

U.S. Pat. No. 3,671,303 (Kimberly-Clark) describes the use of chloride containing binder polymer having Tg below 20° C. together with fire retarding agent to give fire retardency to non-woven wadding. GB 855132 (Celanese) describes a bonded batting. There is no disclosure of the application of copolymer emulsions identified in the present description.

TEST METHODS i) Weight average molecular weight (Mw):

The gel permeation chromatographic (GPC) method used to measure the weight average molecular weight used a Knauer HPLC oven (60cm) and controller together with Erma degasser and Refractive index detector ERC 7510

ACS model 351 solvent delivery system

Phenonomenox Phenogel Linear 6cm column filled with 10 micron polystyrene

Gel crosslinked with divinyl benzene range 500–$10^7$

Rheodyne injector

Trivector Trio integrater and GPC programme.

Sample preparation:

The emulsion was spread onto a glass plate to 0.004 inch thickness, frozen immediately to –20° C. and then placed in vacuum dessicator until dry (usually ca 30 minutes). Approximately 0.2 g of the film was weighed accurately and placed in 100 mls flask. THF (50.0 mls) was added, the flask sealed and shaken overnight. The solution was filtered through GF/D and GF/F filters (What man) into dry 50 mls flask and sealed. 5 mls aliquot was then oven dried in foil dish with weighing to give solubility. A sample of 1 ml was filtered into sample tubes using Millex-SR 0.5 micron filter unit.

The conditions used during the procedure were:

Oven temperature 40° C.

Detector temperature 40° C.

Flow rate 1.0ml/min

Solvent: tetrahydrofuran

Solution concentration Ca 0.2% w/v

Injection volume 100 micro liters.

The procedure was standardised with polystyrene standards, obtainable from Polymer Laboratories of Church Stretton, UK over the range 1160 to $7.7\times10^6$ with quoted Mw/Mn values.

ii) Solution viscosity:

The emulsions were dissolved in tetrahydrofuran to give a solution containing 10% solid material.

The solutions were measured for viscosity on a Carri-Med Controlled Stress Rheometer (Carri-Med Ltd) at 20° C., using a cone (diameter 4 cm) and plate measuring system and run at $1000s^{-1}$. The cone angle was 1:28:30 degree:minutes: seconds. The gap setting was 42.4 micron. The shear rate was increased from zero to $1000s^{-1}$ over 1 minute, held at $1000s^{-1}$ for 1 minute and then reduced to zero over 1 minute. The reading for the viscosity at $1000s^{-1}$ was measured over the 1 minute hold period at $1000s^{-1}$. The viscosity is quoted in poise (10 poise=1Pa.s). A solvent trap was used to enclose the cone because a solvent was present.

iii) Number average molecular weight (Mn):

The Mn of an emulsion is measured using the GPC method with Standards over a range of Mn.

SPECIFIC DESCRIPTION OF THE INVENTION

Examples of polymer emulsions and their use in waddings will now be given to illustrate but not limit the invention.

EXAMPLE 1

Vinyl acetate/vinyl chloride copolymer

A copolymer emulsion comprising a feedstock of vinyl chloride (VC) 320 g, vinyl acetate (VA) 1280 g and sodium vinyl sulphonate (SVS) (8.7% aq. solution) 64g was used.

Water (560 g), perchoroethylene (1.6 g) and disodium half ester of sulphosuccinic acid (25% aq) 192 g (obtained from ABM Chemicals Ltd under the Trade name Pentrone S127) were loaded to a 4 liter reactor and sealed. The contents were heated to 30° C. and purged twice with nitrogen. The vessel was then heated to 73°–75° C. and pressurised to 3 bars nitrogen. 5% of the SVS solution and 5% of the vinyl acetate and vinyl chloride monomers were then added together with 4% of a total sodium persulphate charge of 8 g in 140 g water. The contents were maintained at 73°–75° C. for 5 minutes with stirring.

The remainder of the sodium vinyl sulphonate, vinyl acetate, vinyl chloride and sodium persulphate was then added continuously over a period of 4 hours while maintaining a temperature of 73°–75° C. When the additions had been completed, the reaction contents were taken to 80° C. and held at that temperature for 30 minutes. They were then cooled to below 30° C. and removed to another sealed vessel and potassium hydroxide (25% aq. solution 10 g) and formalin (5.7 g) were added with stirring.

This emulsion, which had a Tg of 40° C. and a solubility above 80% in THF, is usable in the commercial preparation of a lofted non-woven prepared from polyester fibre. The lofted non-woven was first prepared from polyester fibre using conventional non-woven preparative techniques to provide a material having a bulk density of 3 to 5 $Kg/m^3$ and a thickness of 10–50 mm. This material was sprayed on both sides with the emulsion diluted with water to a concentration of 10% to 30% solids. The application rate of copolymer was between 5 to 25 g of dry copolymer per square meter of wadding surface on each side.

The material was dried conventionally in a three pass oven with a dwell time of between 50 and 60 seconds on each pass. The temperature in each pass was increased, as conventional, from 90°/100° C. for the first pass to 100°/120° C. for the second pass and 140°/160° C. for the third pass.

The binder emulsion prepared as above was subjected to laboratory tests for flammability.

The substrate used was a thermally bonded polyester wadding—comprising conventional crimped polyester fibres (70%) blended with polyester binder fibres (30%). These latter fibres comprise typically a core of normal P.E.T with a sheath of lower molecular weight P.E.T capable of melting and thus bonding other fibres during the manufacturing process.

This type of wadding does not exhibit surface spread of flame in the tests, and is thus a suitable substrate for assessing sprayable binders.

The candidate binders were diluted with an equal volume of water, and a very small quantity of pigment added to colour the binder. (This was to assist the application of an even spray pattern).

The diluted binders were then applied using a hand held spray gun to one side only of a piece of thermally bonded wadding. Each piece was pre-weighed and of approximately 20 cm×30 cm in size. The wadding was approximately 300 $g/m^2$ with a thickness of 45 mm.

Sufficient binder was applied so that the final article contained between 5 and 7% by weight of dry binder of the total finished weight, equivalent to a dry coating weight of approximately 20 $g/m^2$.

The final article was dried in a laboratory oven operating at 130° C. for 15 minutes, and was then conditioned for 24 hours at 20°±2° C. with relative humidity at 65±2%, prior to testing.

A simple method of test was devised, which gives some indication of the likely performance of the finished article in such tests as BS 5852 Part 2, flame source 2.

Here the wadding sample as previously prepared, was placed in a draught free testing cabinet, with the sprayed side uppermost. A lighted match was then placed onto the surface of the test sample.

Upon cessation of all signs of flaming and smouldering, the samples were visually inspected.

A good result, shown by the binders of this invention, was represented by a small hole, caused by the burning match, with no spread of fire damage outside this hole.

A poor result, shown by other binders, would in an extreme case, be exhibited by complete destruction of the top surface, leading to numerous holes being burnt through the article.

Additional copolymer emulsions usable as binders for lofted non-wovens are given in Table I.

TABLE I

| MONOMERS | STABILISING SYSTEM | Tg | Mw |
|---|---|---|---|
| VA | Surfactant (Anionic) | 32 | $1.46 \times 10^6$ |
| VA | Polysaccharide Gum/ Surfactant (Nonionic) | 32 | $2.80 \times 10^5$ |
| VA | Surfactant (Nonionic/ Anionic)/PVP | 32 | $4.20 \times 10^4$ |
| VA | Surfactant (nonionic/ Anionic)/Low M.W. Polyelectrolye | 32 | $1.71 \times 10^5$ |
| VA/alpha-Olefin | Cellulose Ether/ Surfactant (Nonionic/ Anionic) | ** | $4.33 \times 10^5$ |
| VA/ crotonic Acid | Starch Ether/Surfactant (Nonionic) | ** | $3.03 \cdot 10^5$ |
| Methyl methacrylate ethylacylate Acrylic Acid | Surfactant (Nonionic/Anionic) | 22 | $4.21 \times 10^4$ |
| VA/VC | Surfactant (Anionic) | 40 | $5.48 \times 10^5$ |

**not calculated

EXAMPLE II

Styrene Acrylate Polymer 0.9 gm Empicol LXV (sodium lauryl sulphate [85% active] obtainable from Albright & Wilson Ltd) in 50 gm water was loaded to a reactor. This solution was purged through with nitrogen for 15 minutes and then over the surface for 15 minutes. 10% of a pre-emulsion consisting of 207 gm styrene, 81 gm butyl acrylate, 12 gm acrylic acid, 12 gm Ethylan BCP (nonylphenol 9EO obtainable from Lankro Chemicals Ltd) and 3 gm lauryl mercaptan in 17.2 gm Synperonic NP30 (aq 70% of nonylphenol 30EO obtainable from Cargo Fleet Chemicals Co. Ltd) and 115 gm water was then added to the reactor and stirred for 5 minutes. The temperature of the contents of the reactor were adjusted to 18°–20° C. 0.75 gm ammonium persulphate in 12 gm water followed by 0.45 gm ferric chloride (0.1% $Fe^{3+}$) were then added. 0.75 gm sodium metabisulphite in 12 gm water was then added and the contents were allowed to exotherm.

At the maximum exotherm, the addition of the remaining 90% of the pre-emulsion was commenced and added over 3 hours. At the same time additions of 0.75 gm ammonium persulphate in 50 gm water and 0.75 gm sodium metabisulphite in 50 gm water were commenced, also added over 3 hours. The temperature of the reactor contents was raised to 49°–51° C. and the temperature maintained at 49°–51° C. for the duration of the additions.

After the continuous additions were completed, the temperature of the reactor contents was maintained at 49°–51° C. for 15 minutes. 3 gm methyl methacrylate was added and again the contents were held for 15 minutes at 49°–51° C. 0.3 gm ammonium persulphate in 3 gm water followed by 0.15 gm formosul (sodium formaldehyde sulphoxylate) in 3 gm water were then added. The temperature was held at 49°–51° C. for a further 15 minutes and 0.3 gm t-butyl hydroperoxide was then added. The temperature was again held at 49°–51° C. for a further 15 minutes.

The emulsion formed was cooled to 30° C. and the pH adjusted with portions of ammonia (0.880) diluted 1:1 with water. 1.3 gm of formalin was added to the emulsion as preservative.

The emulsion had a non-volatile content 51.4%, pH 6.05 and viscosity 2.0 poise (Brookfield RTV Spindle 3/Speed 20). Its solubility in THF was above 80%.

The copolymer emulsions of Examples II, III, IV & V were subjected to the test method described above but with the final article containing 20% by weight of dry binder relative to the total finished weight in place of between 5% and 7% by weight. Additionally the area burnt by the match laid on the surface of the article was measured as a precentage of the total area. The match will cause a minimum area of burning even if the melting away of the non woven binder is almost perfect.

The copolymer emulsion of this example was compared with a styrene/acrylate copolymer available commercially from Vinamul Ltd Carshalton England as V7170. The results are given in Table II.

TABLE II

| Product | THF (10%) | Mn | Mw | Tg | Area burnt |
|---|---|---|---|---|---|
| V7170 | 3.06 | 58,100 | 1,350,000 | | 100% |
| Ex II | 0.106 | 24,700 | 636,000 | 45° C. | 8.3% |

EXAMPLE III

Acrylic polymer 1.5 gm Arylan SC 15 (sodium dodecyl benzene sulphonate [aq 15%] obtainable from Lankro Chemicals Ltd) and 1.0 gm Synperonic NP35 (nonylphenol 35EO obtainable from Cargo Fleet Chemicals Co. Ltd) were dissolved in 300 gm water in a reactor. To this solution, a mixture of 16.5 gm methyl methacrylate, 8.5 gm butyl acrylate and 0.25 gm lauryl mercaptan were added. The contents were then heated to 65° C. whilst purging with nitrogen over the surface. At 65° C. a solution of 2.5 gm ammonium persulphate in 10 gm water was added. When the batch exothermed the temperature was taken to 71° C.

At 71° C. a pre-emulsion, consisting of 5.0 gm Synperonic NP35, 58.5 gm Arylan SC15 and 155.0 gm water dispersed with 313.5 gm methyl methacrylate, 161.5 gm butyl acrylate and 4.75 gm lauryl mercaptan, was started adding to the reactor and added over 4½ hours. At the same time an addition of 2.5 gm ammonium persulphate in 50 gm water was started and also added over 4½ hours. The temperature was allowed to rise to 74°–76° C. and was maintained at this temperature until the end of the continuous additions. When these additions were complete the temperature was taken to 80° C. and held for 30 minutes. The emulsion was then cooled to 30° C.

At 30° C., a solution of 0.85 gm t-butyl hydroperoxide in 10 gm water was added. A solution of 0.75 gm formosul in 15 gm water was then added over 1 hour. Portions of ammonia (0.880) diluted 1:1 with water were then added to adjust the pH.

The product emulsion contained non-volatiles 46.0%, had pH of 5.9, and viscosity 0.23 poise (Brookfield RTV Spindle 1/Speed 50). Its solubility in THF was above 80%.

The acrylate copolymer emulsion of this Example was compared with an acrylate emulsion IIIA. Comparison product IIIA was prepared by omitting Synperonic NP35 from the initial solution and the two additions of lauryl mercaptan.

The results are given in Table III.

TABLE III

| Product | THF (10%) | Mn | Mw | Tg | Area burnt |
|---|---|---|---|---|---|
| Ex IIIA | 0.82 | 86,700 | 555,000 | | 100% |
| Ex III | 0.077 | 18,900 | 46,400 | 36° C. | 8.3% |

EXAMPLE IV

Vinyl Acetate/Maleate Polymer 36 gm Pentrone S127 and 105 gm water were loaded to a reactor. This solution was heated to 73°–75° C. whilst purging with nitrogen. At 73°–75° C., 0.3 gm lauryl mercaptan was added. After 5 minutes, 5% of a solution of 12 gm sodium vinyl sulphonate (aq 25%) in 19 gm water was added, also at 73°–75° C. After 5 minutes 5% of a solution of 4.5 gm lauryl mercaptan in 60 gm dimethyl maleate and 240 gm vinyl acetate was added, also at 73°–75° C. After 5 minutes, 4% of a solution of 1.5 gm sodium persulphate in 29.5 gm water was added, also at 73°–75° C.

After 5 minutes, the continuous additions of the remainder of the sodium vinyl sulphonate solution, sodium persulphate solution and lauryl mercaptan/vinyl acetate/dimethyl maleate mixture were all commenced and added over 4 hours while maintaining the reactor contents at 73°–75° C. When all these additions had been completed, the temperature was taken to 80° C. for 30 minutes.

After this hold period the emulsion was cooled to below 30° C. Potassium hyroxide (aq 25%) was added to adjust the pH and 1.07 gm formalin (aq 40%) was added as preservative.

The product emulsion had a solid content of 61.9%, pH 5.0, a viscosity (Brookfield spindle/speed 4.20) of 37.5 poise and a Tg of 36° C. Its solubility in THF was above 80%.

The product emulsion had a THF (10%) viscosity of 0.068 poise, Mw 48,136, Mn of 18,400 and burnt 10% of the area.

EXAMPLE V

Vinyl Acetate Polymer 36 gm Pentrone S127 and 105 gm water were loaded to a reactor. This solution was heated to 73°–75° C. whilst purging with nitrogen. At 73°–75° C., 0.3 gm lauryl mercaptan was added. After 5 minutes, 5% of a solution of 12 gm sodium vinyl sulphonate (aq 25%) in 19 gm water was added, also at 73°–75° C. After another 5 minutes, 5% of a solution of 4.5 gm lauryl mercaptan in 300 gm vinyl acetate was added, also at 73°–75° C. After another 5 minutes, 4% of a solution of 1.5 gm sodium persulphate in 29.5 gm water was added, also at 73°–75° C.

After another period of 5 minutes, the continuous additions of the remainder of the sodium vinyl sulphonate solution, sodium persulphate solution and lauryl mercaptan/vinyl acetate mixtures were all commenced and added over 4 hours while maintaining the reactor contents at 73°–75° C. When all these continuous additions were added, the temperature was taken to 80° C. for 30 minutes.

After this hold period the emulsion was cooled to below 30° C. Potassium hydroxide (aq 25%) was added to adjust the pH and 1.07 gm formalin (aq 40%) added as preservative.

The product emulsion had a solid content of 62.1%, pH of 5.3 and viscosity (Brookfield spindle/speed 4.20) 9.0 poise. Its solubility in THF was above 80%.

The product emulsion was compared with a polyvinyl acetate product commercially obtainable from Vinamul Ltd of Carshalton England as V9300. The results are given in Table IV.

TABLE IV

| Product | THF (10%) | Mn | Mw | Tg | Area burnt |
|---|---|---|---|---|---|
| V9300 | 0.263 | 21,000 | 1,460,000 | | 100% |
| Ex V | 0.051 | 12,000 | 38,900 | 30° C. | 11.3% |

The copolymer emulsions within the invention may be blended with a relatively small quantity of an emulsion which does not satisfy the desired characteristics of the copolymers of the invention. An example of such a copolymer emulsion comprises VA/VC/ethylene stabilised with an anionic surfactant and having a degree of crosslinking. An emulsion of this class would provide a harder bond for the wadding.

We claim:

1. An ignition resistant lofted non-woven wadding material comprising a web of lofted nonwoven fibers bonded by a polymer emulsion having:

i) a Tg from about 20° C. to about 60° C., ii) a weight average molecular weight less than about $3\times10^6$ for homopolymers and a weight average molecular weight less than about $5\times10^5$ for copolymers, and being substantially free of crosslinking or being substantially non-crosslinkable on drying, iii) a ratio of Mw/Mn below about 5 and a solution viscosity below about 0.15 poise in tetrahydrofuran at 10% solid material, and iv) the polymer of the polymer emulsion consisting essentially of a compound selected from the group consisting of copolymers of a vinyl $C_1$–$C_3$ alkanoate with vinyl chloride, ethylenic hydrocarbons, or alkyl maleates; copolymers of styrene and an acrylate; copolymers of methacrylates and acrylates, homopolymers of vinyl $C_1$–$C_3$ alkanoates; and homopolymers of dimethylmaleate, wherein the emulsion polymer has low inherent flammability and forms a melt on application of a flame which shrinks back from the flame without forming a gel which holds the fibers in place.

2. A wadding according to claim 1 wherein the polymer is a copolymer and has a weight average molecular weight less than about $10^5$.

3. A wadding according to claim 1 wherein the polymer has a solution viscosity below about 0.10 poise in tetrahydrofuran at 10% solid material.

4. A wadding according to claim 1 wherein the polymer is a homopolymer or copolymer of vinyl acetate.

5. A wadding according to claim 1 wherein the fibers are polyester fibers.

6. A wadding according to claim 1 wherein the polymer is a vinyl acetate homopolymer, vinyl acetate/vinyl chloride copolymer, vinyl acetate/alpha-olefin copolymer, vinyl acetate/crotonic acid copolymer, vinyl acetate/ dimethyl maleate copolymer, methmethacrylate/ethyl acrylate/acrylic acid copolymer, styrene/butyl acrylate copolymer, or methyl methacrylate/butyl acrylate copolymer.

7. A wadding according to claim 6 wherein the fibers are thermally bonded polyester fibers.

* * * * *